US010457429B1

(12) United States Patent
Guyer et al.

(10) Patent No.: US 10,457,429 B1
(45) Date of Patent: Oct. 29, 2019

(54) PAIR OF JAWS FOR A TWIST-TYING MACHINE

(71) Applicant: Johnson International Corporation, Tustin, CA (US)

(72) Inventors: Sean Guyer, Tustin, CA (US); Jack Hoffa, Tustin, CA (US); Carlos Contreras, Tustin, CA (US)

(73) Assignee: Johnson International Corporation, Tustin, CA (US)

( * ) Notice: Subject to any disclaimer, the term of this patent is extended or adjusted under 35 U.S.C. 154(b) by 388 days.

(21) Appl. No.: 15/256,545

(22) Filed: Sep. 3, 2016

(51) Int. Cl.
*B21F 15/04* (2006.01)
*B65B 13/28* (2006.01)

(52) U.S. Cl.
CPC ..... *B65B 13/28* (2013.01); *B21F 15/04* (2013.01)

(58) Field of Classification Search
CPC ..... B65B 13/04; B65B 13/14; B65B 13/28; B65B 13/285; B65B 27/06; B65B 27/08; B65B 27/10; B65B 27/12; B21F 15/04; E04G 21/123
USPC ..... 140/6, 93, 118, 119; 100/31
See application file for complete search history.

(56) References Cited

U.S. PATENT DOCUMENTS

| | | | |
|---|---|---|---|
| 3,168,032 | A | 2/1965 | Faulkuer |
| 3,946,769 | A | 3/1976 | Caveney et al. |
| 4,371,011 | A | 2/1983 | Hidassy |
| 4,534,817 | A | 8/1985 | O'Sullivan |
| 5,944,063 | A | 8/1999 | Kurmis |
| 6,136,118 | A | 10/2000 | Bartholomew et al. |
| 6,279,620 | B1 | 8/2001 | Eason et al. |
| 6,302,157 | B1 | 10/2001 | Deschenes et al. |
| 6,354,336 | B1 | 3/2002 | Leban |
| 6,484,366 | B1 | 11/2002 | Deschenes et al. |
| 6,513,555 | B1 | 2/2003 | Lesser et al. |

(Continued)

FOREIGN PATENT DOCUMENTS

| | | |
|---|---|---|
| DE | 2705418 C2 | 5/1984 |
| DE | 4035967 A1 | 5/1991 |

(Continued)

OTHER PUBLICATIONS

Title: Autotool 2000 Author(s) Hellermanntyton Link http://www.hellermanntyton.com/site/binaries/content/assets/competences/com/chapter-6/autotool_2000_brochure_gb_aug2007.pdf.

(Continued)

*Primary Examiner* — Shelley M Self
*Assistant Examiner* — Katie L. Parr
(74) *Attorney, Agent, or Firm* — Law Office of Michael O'Brien; Michael O'Brien

(57) ABSTRACT

A pair of jaws for a twist tying machine enables a user to tie products with a small outer diameter. The pair of jaws includes a fixed jaw that has a generally cylindrical housing attached to the twist tying machine and extending to a flat distal edge. A fixed jaw channel is formed within the fixed jaw and configured to accommodate a product tie from the twist tying machine. A movable jaw is rotatably attached to the twist tying machine and extends to a movable jaw distal end. A movable jaw channel is formed within the movable jaw and configured to accommodate the product tie from the fixed jaw channel. Closing the movable jaw against the fixed jaw enables the product tie to travel through the movable jaw around a product, and through the fixed jaw creating a tie around the product.

8 Claims, 7 Drawing Sheets

(56) References Cited

U.S. PATENT DOCUMENTS

| | | | | |
|---|---|---|---|---|
| 7,334,610 | B2 | 2/2008 | Levin et al. | |
| 8,240,343 | B2 | 8/2012 | Dyer et al. | |
| 8,281,712 | B1 * | 10/2012 | Hoffa | B21F 3/00 100/31 |
| 8,397,767 | B2 | 3/2013 | Nagaoka | |
| 8,622,440 | B2 | 1/2014 | Crichton et al. | |
| 2004/0045452 | A1 | 3/2004 | Schumacher et al. | |
| 2007/0034338 | A1 | 2/2007 | Ogawa | |
| 2011/0072763 | A1 | 3/2011 | Schaety et al. | |

FOREIGN PATENT DOCUMENTS

| | | | |
|---|---|---|---|
| EP | 399599 | A1 | 11/1990 |
| EP | 267830 | B1 | 6/1991 |
| EP | 596363 | B1 | 1/1997 |
| EP | 942868 | B1 | 3/2005 |
| EP | 1231141 | B1 | 1/2006 |
| GB | 2006152 | B | 1/1982 |

OTHER PUBLICATIONS

Title: Construction Tool Ni-Mh Battery Tool for Rebar Tie Wire Rebar Size 4*4-20* 20mm Automatic Tying Machine Made in China RT-395 Author(s) Janejin2002 Link http://www.dhgate.com/product/construction-tool-ni-mh-battery-tool-for/256925370.html#sd1-12-1a;rvw|1500905631.

* cited by examiner

PAIR OF JAWS FOR A TWIST-TYING MACHINE

BACKGROUND

The embodiments herein relate generally to machines that wrap a tie around a product. In some cases the tie can be made from wire or laminated. Ties can be laminated with plastic, paper or a combination of these. The products can include clothes hangers, parts kits, coiled materials, bags, and agricultural products among other products. These are commonly called, "twist-tying machines." Some endeavors in this field include: U.S. Pat. No. 4,534,817 issued to O'Sullivan; U.S. Pat. No. 6,513,555 issued to Raymond; U.S. Pat. No. 8,240,343 issued to Dyer; U.S. Pat. No. 4,371,011 issued to Hidassy; U.S. Pat. No. 6,354,336 issued to LeBan; U.S. Pat. Nos. 6,484,366 and 6,302,157 issued to Deschenes; U.S. Patent Application Pre-Grant Publication 2004/0045452 filed by Schumacher; German Patent 4,035,967 filed by Kurmis; U.S. Pat. No. 7,334,610 issued to Levin; U.S. Pat. No. 8,397,767 issued to Nagaoka; U.S. Pat. No. 8,622,440 issued to Crichton; U.S. Patent Application Pre-grant publication US20070034338A1 filed by Ogawa; U.S. Patent Application Pre-grant Publication 2011/0072763 issued to Schaety; and U.S. Pat. No. 4,094,342 issued to Nishikawa.

O'Sullivan and Hidassy teach a product-wrapping and tying device that has a pair of jaws comprising a lower fixed jaw and a pivotal moving upper jaw. The jaws are thin ring-shaped in O'Sullivan. Hidassy is similar with a hook shape. Schaety uses a flat movable lower jaw. Schumacher and Ogawa have the lower jaw movable. Instead of one jaw Crichton uses a pair of ring assemblies.

Lesser, LeBan, and Nishikawa teach automatically operating binding devices with guide jaws. The guide jaws include a guide groove that is aligned with the inlet end of the through-channel in the lock when the jaws are closed. The groove is aligned with the insertion channel of the lock at its outlet end. LeBan teaches that both jaws have a circumferential guide track that accepts the strap of a cable tie. Deschenes would use a jaw assembly comprising an upper jaw, a cam, a linkage, a lower jaw and a jaw assembly motor which is electrically connected to a control circuit and which is activated by depressing a trigger. Kurmis attaches the lower jaw to a cam instead of the upper jaw.

Dyer teaches a jaw assembly for use with a twist tying device. The jaw assembly includes an upper jaw receiver is disposed between the guide groove of the distal portion of the upper jaw and the guide groove of the proximal portion of the upper jaw. The guide groove within the proximal portion of the upper jaw is tapered inwardly deeper and away from the upper jaw edge at its distal-most point. Levin has a groove, but goes another way entirely using the rear jaw to mate the tool to a fixture through a mounting pin instead of the groove. Nagaoka teaches that feeding a wire through a guide part that appeals to be more of tunnel than a channel is efficient.

SUMMARY

A pair of jaws for a twist tying machine enables a user to tie products with a small outer diameter. The pair of jaws includes a fixed jaw that has a generally cylindrical housing attached to the twist tying machine and extending to a flat distal edge. A fixed jaw channel is formed within the fixed jaw and configured to accommodate a product tie from the twist tying machine. A movable jaw is rotatably attached to the twist tying machine and extends to a movable jaw distal end. A movable jaw channel is formed within the movable jaw and configured to accommodate the product tie from the fixed jaw channel. Closing the movable jaw against the fixed jaw enables the product tie to travel through the movable jaw around a product, and through the fixed jaw creating a tie around the product.

In some embodiments, a flat distal edge line is parallel to the flat distal edge. An inclined portion transitions from the flat distal edge. The inclined portion is parallel to an inclined portion line. A fixed jaw transition angle is measured from the flat distal edge line to the inclined portion line. The fixed jaw transition angle is at least zero degrees but no more than ninety degrees.

In some embodiments, a fixed jaw channel opening is hollowed out from the inclined portion. The fixed jaw channel opening is the beginning of the fixed jaw channel further comprising a modified rectangular opening having a fixed jaw channel outer wall, a fixed jaw channel upper wall, and a fixed jaw channel lower wall. A fixed jaw upper concave portion is formed into the fixed jaw channel upper wall. A fixed jaw lower concave portion is formed into the fixed jaw channel lower wall.

In some embodiments, the movable jaw further comprises a movable jaw lower surface. A movable jaw outer surface is smoothly connected to the movable jaw lower surface. A movable jaw upper surface is smoothly connected to the movable jaw outer surface. A movable jaw lower attachment portion is smoothly connected to the movable jaw lower surface. The movable jaw lower attachment portion is rotationally coupled to a linkage system on the twist tying machine. A movable jaw upper attachment portion is smoothly connected to the movable jaw upper surface. The movable jaw upper attachment portion is rotationally coupled to the linkage system on the twist tying machine.

In some embodiments, the movable jaw further comprises a movable jaw lower lip joined to the movable jaw lower surface. The movable jaw lower lip is centrally aligned on a movable jaw lower lip axis. A movable jaw upper lip is joined to the movable jaw upper surface; wherein the movable jaw upper lip is centrally aligned on a movable jaw upper lip axis. A movable jaw transition angle is measured from the movable jaw lower lip axis to the movable jaw upper lip axis. The movable jaw transition angle is at least zero degrees but no more than ninety degrees.

In some embodiments, a movable jaw channel upper wall is smoothly connected to the movable jaw upper lip. A movable jaw channel lower wall is smoothly connected to the movable jaw lower lip. The movable jaw distal end is smoothly connected to the movable jaw outer surface. The movable jaw distal end further comprises the movable jaw channel.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
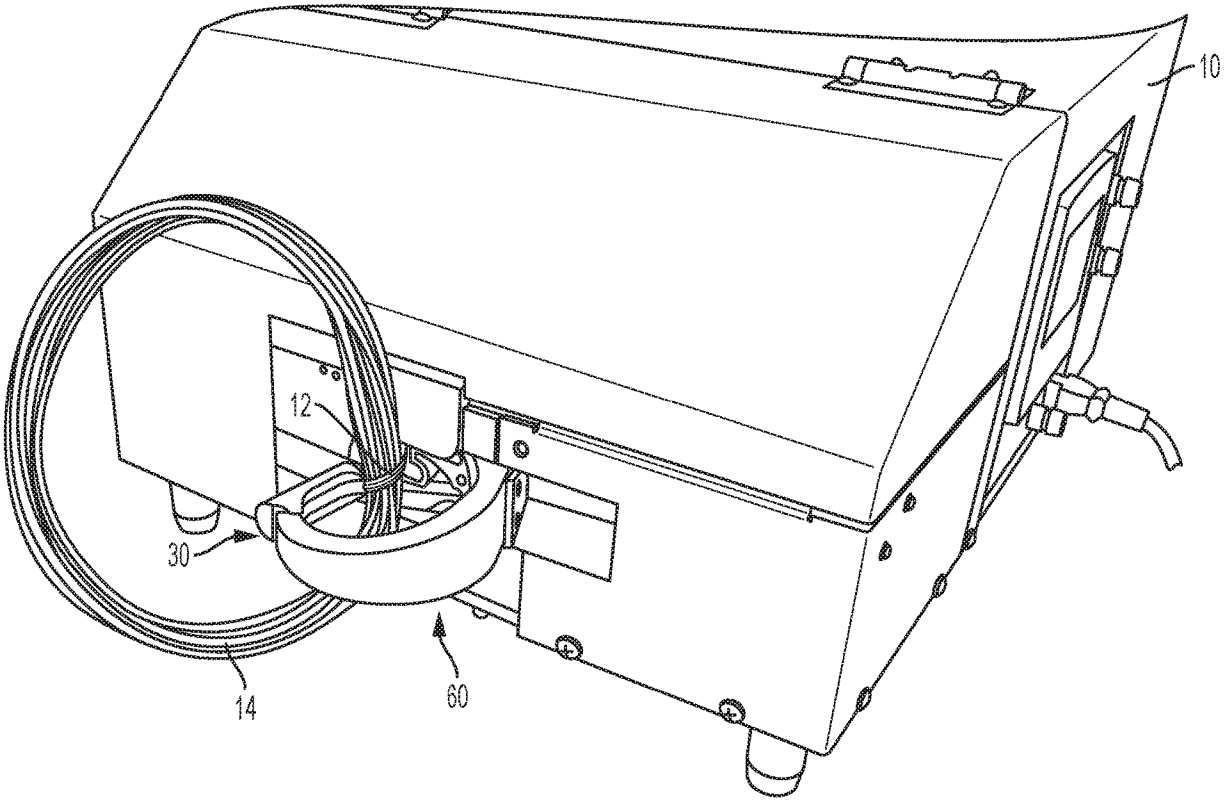
FIG. 1 shows a perspective view of one embodiment of the present invention in use.

By way of example, and referring to FIG. 1, twist tying machine 10 is configured to dispense a product tie 12 around a coil of wires 14. Previously, it was impossible to wrap a product tie 12 around a small inner diameter coil of wires 14. This was because in order for the product tie 12 to wrap around a small inner diameter coil of wires 14, the product tie 12 would have to be bent over and upon itself in a small area, and existing jaws could not accommodate this.

In some embodiments, the twist tying machine 10 dispenses a product tie in a semi-automatic, automatic or manual operation. The twist tying machine 10 can be fully automated and utilized by an operator.

This problem is solved with a pair of jaws 20. The pair of jaws 20 further comprises a fixed jaw 30 attached to twist tying machine 10. The fixed jaw 30 further comprises a generally cylindrical housing 32 extending from the twist tying machine 10 to a flat distal edge 34. The flat distal edge 34 is parallel to a flat distal edge line 36. The flat distal edge 34 transitions to an inclined portion 38. The inclined portion 38 is parallel to an inclined portion line 40. A fixed jaw transition angle θ1 can be measured from the flat distal edge line 36 to the inclined portion line 40. The fixed jaw transition angle θ1 can be in a range of zero degrees to ninety degrees, but is preferably about thirty-five degrees. The inclined portion 38 is hollowed out by a fixed jaw channel opening 42.

The fixed jaw channel opening 42 is the beginning of a fixed jaw channel 44 which is defined as a modified rectangular opening having a fixed jaw channel outer wall 46, a fixed jaw channel upper wall 48, and a fixed jaw channel lower wall 50. The fixed jaw channel upper wall 48 terminates at a fixed jaw upper concave portion 52. Likewise, the fixed jaw channel lower wall 50 terminates at a fixed jaw lower concave portion 54.

Figure 2:
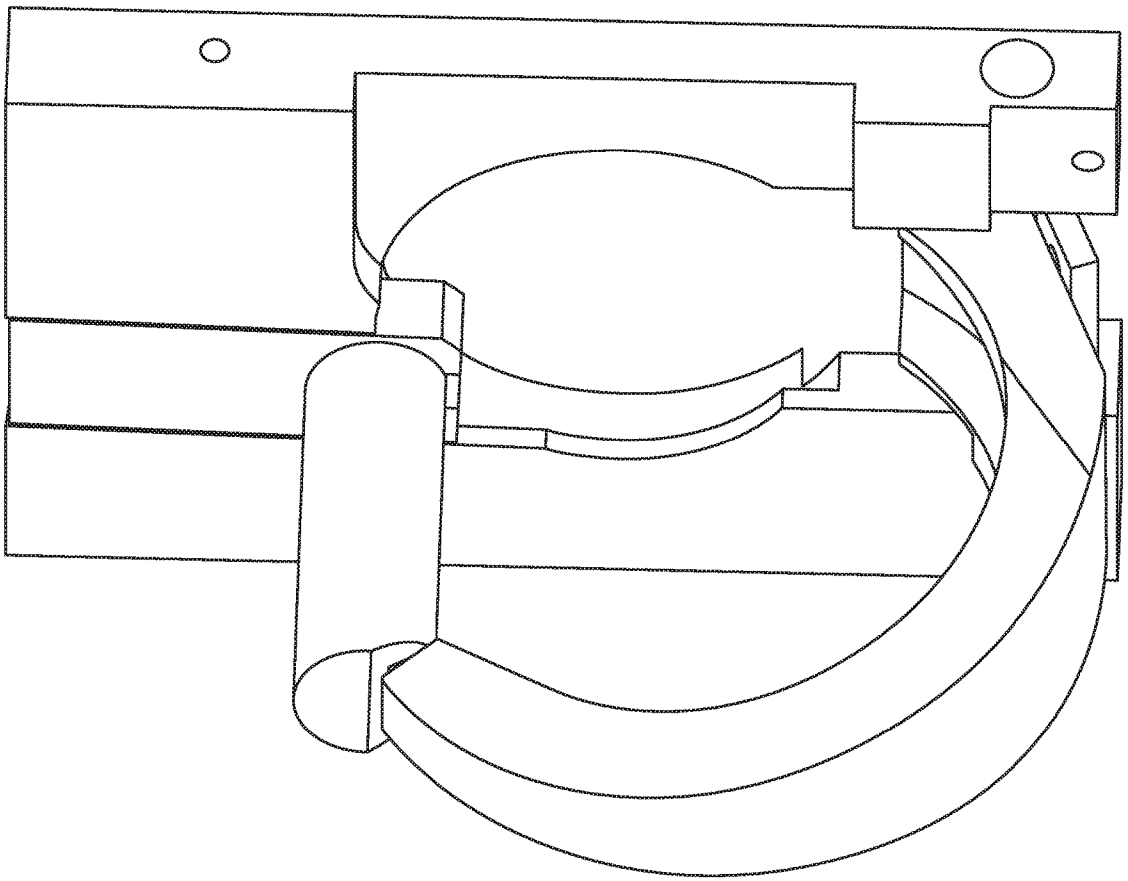
FIG. 2 shows a top perspective view of one embodiment of the present invention in use.
Figure 3:
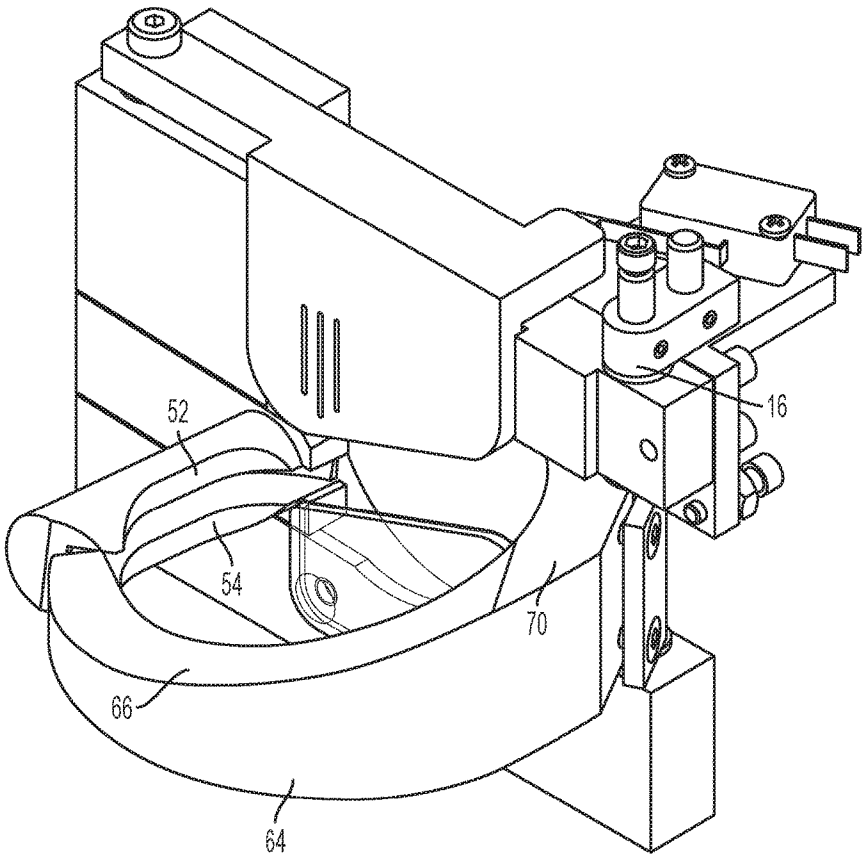
FIG. 3 shows a side perspective view of one embodiment of the present invention in use.
Figure 4:
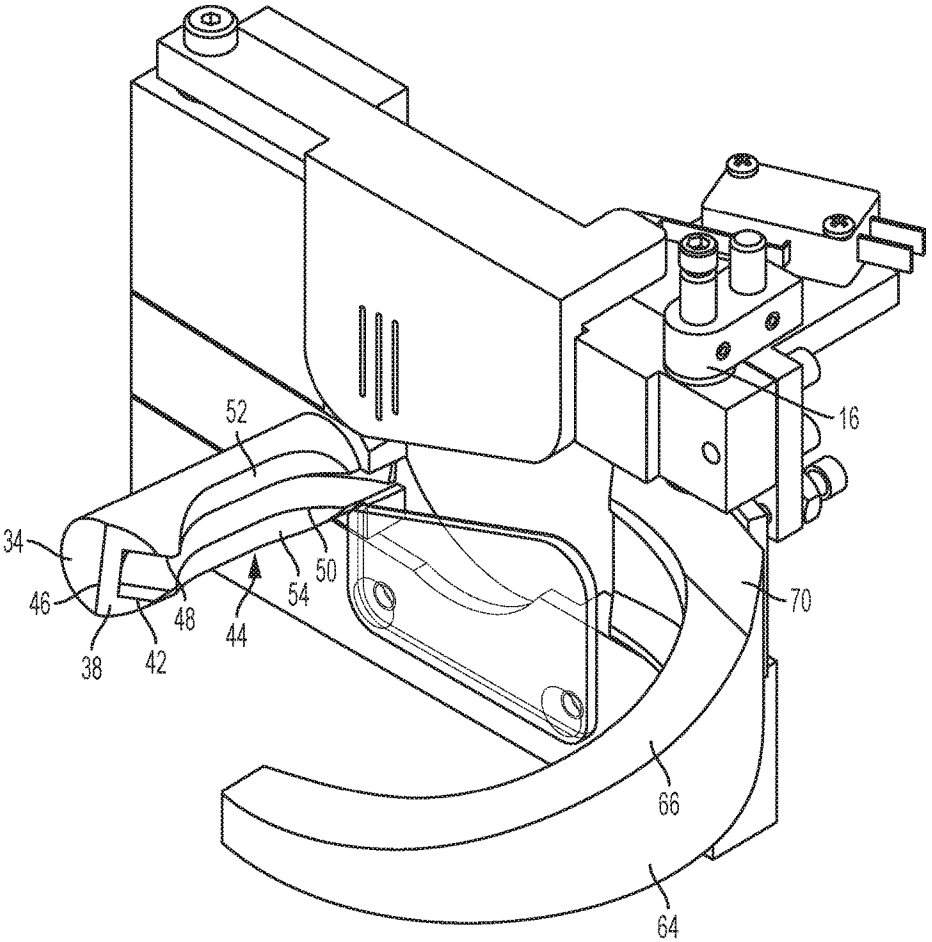
FIG. 4 shows a side perspective view of one embodiment of the present invention in use.
Figure 5:
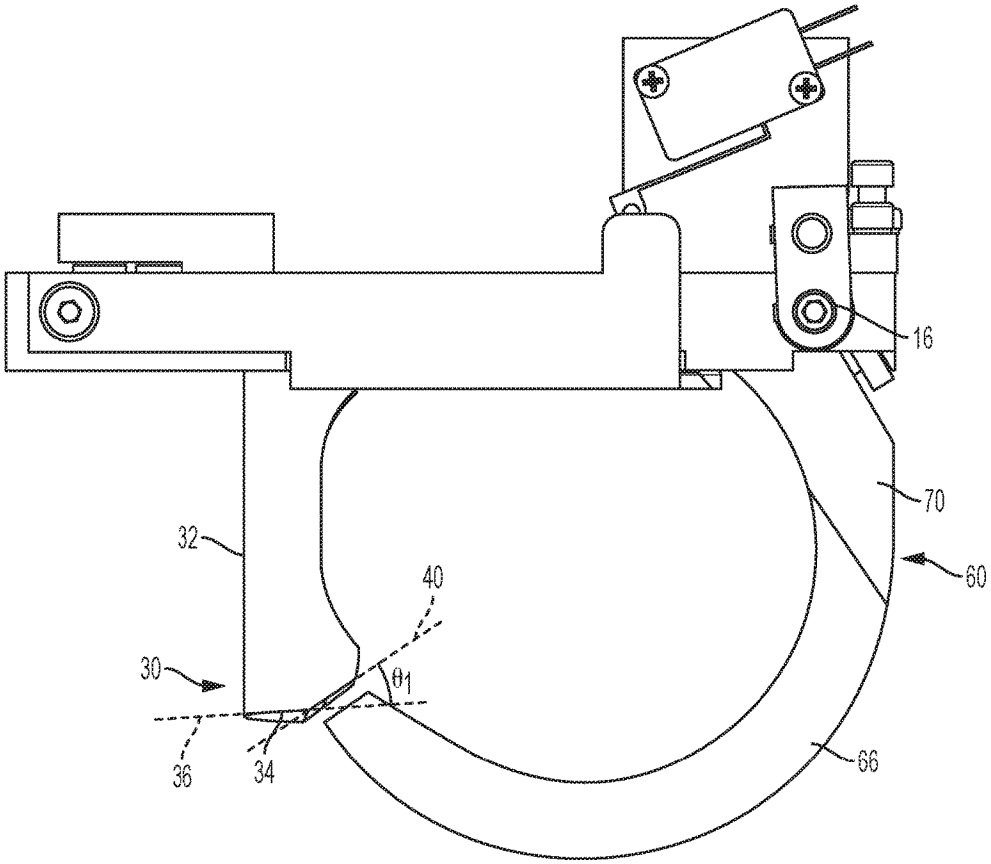
FIG. 5 shows a top view of one embodiment of the present invention in use.
Figure 6:
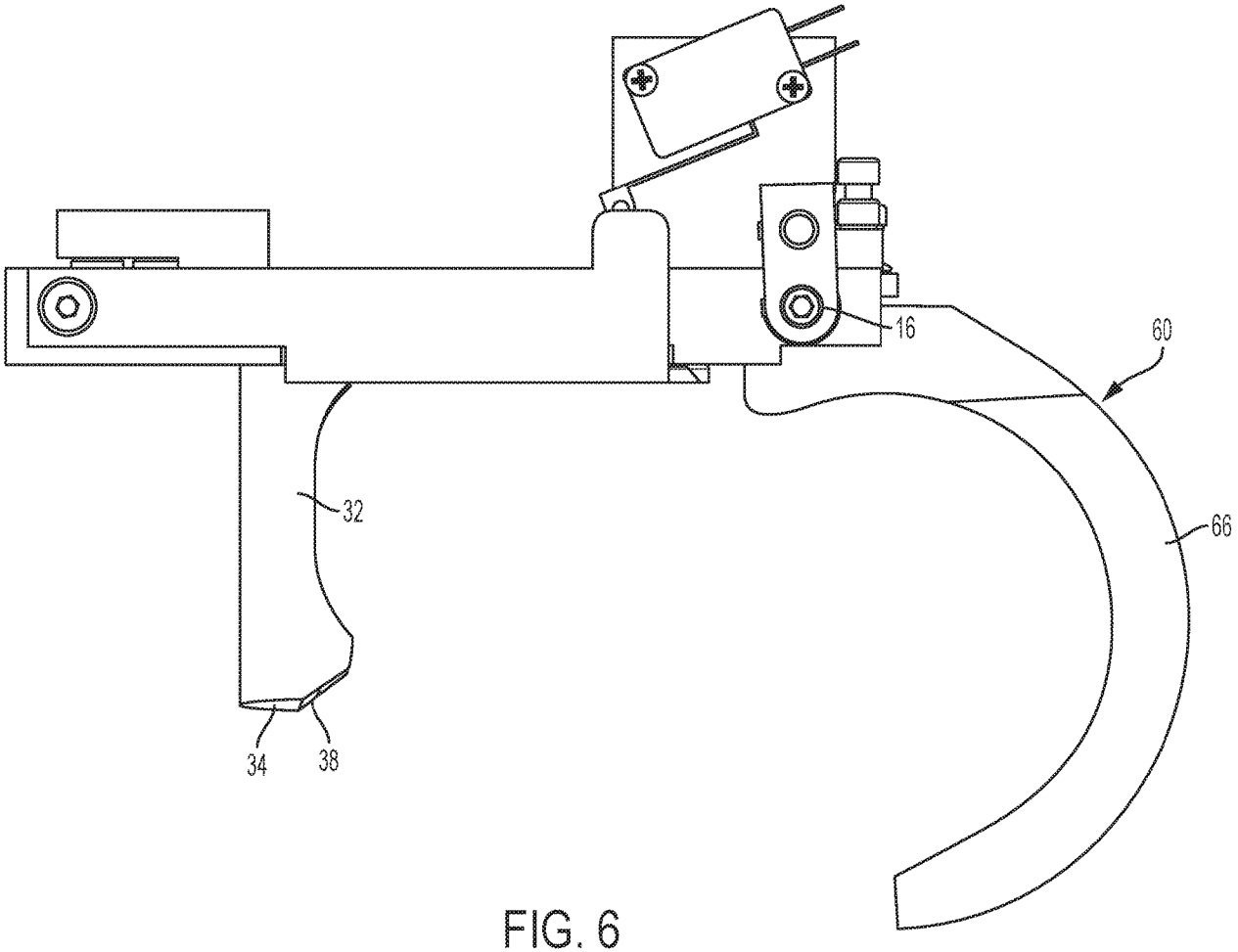
FIG. 6 shows a top view of one embodiment of the present invention in use.
Figure 7:
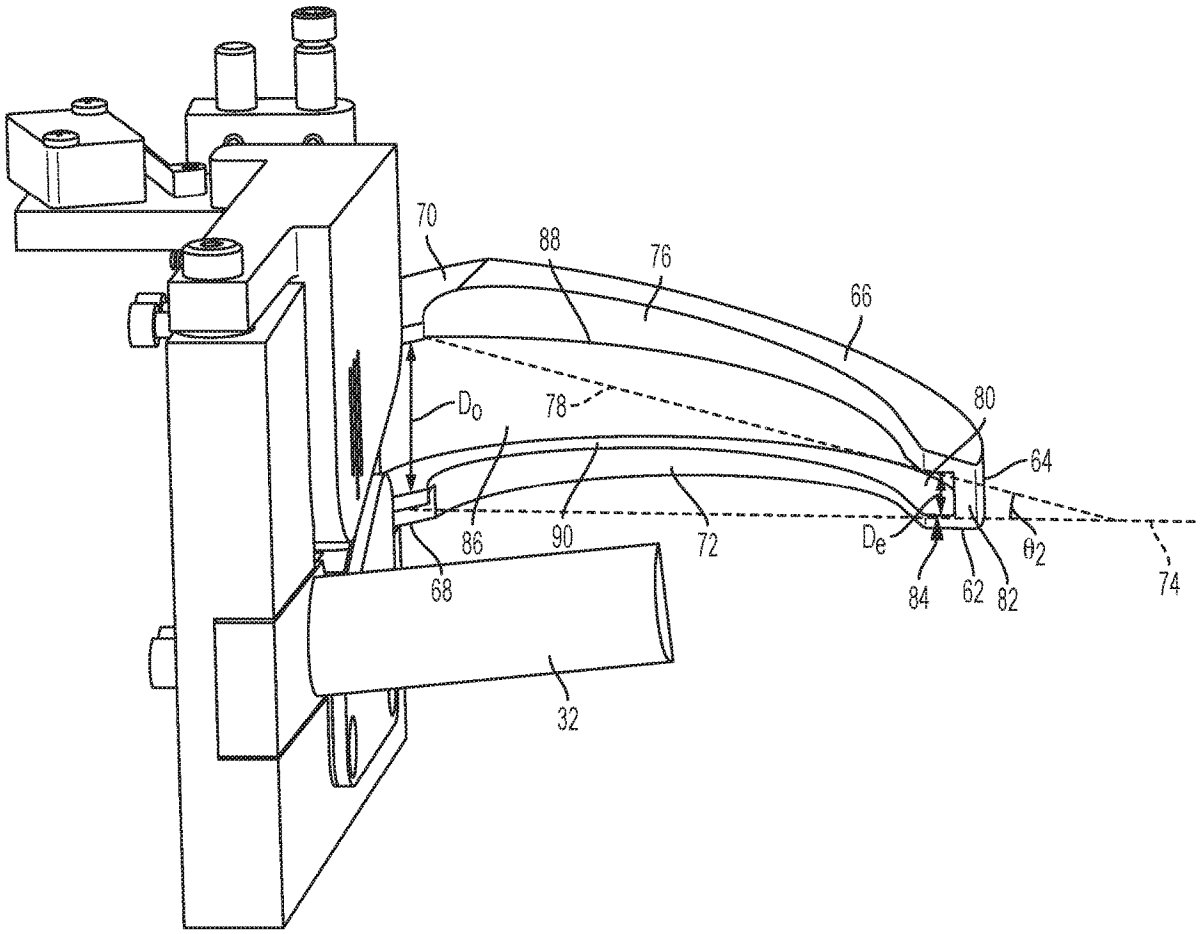
FIG. 7 shows a side perspective view of one embodiment of the present invention in use.

The movable jaw 60 is attached to twist tying machine 10 with linkage system 16. Linkage system 16 rotates the movable jaw 60 from an open position as shown, for example, in FIG. 6 toward fixed jaw 30 as shown, for example in FIG. 2.

The movable jaw 60 further comprises a movable jaw lower surface 62, which is smoothly connected to a movable jaw outer surface 64. The movable jaw outer surface 64 is smoothly connected to a movable jaw upper surface 66. The movable jaw lower surface 62 is joined to a movable jaw lower attachment portion 68, which is rotationally coupled to linkage system 16. The movable jaw upper surface 66 is joined to a movable jaw upper attachment portion 70, which is rotationally coupled to the linkage system 16.

The movable jaw lower surface 62 is joined to a movable jaw lower lip 72. The movable jaw lower lip 72 is centrally aligned on a movable jaw lower lip axis 74. The movable jaw upper attachment portion 70 is joined to a movable jaw upper lip 76. The movable jaw upper lip 76 is centrally aligned on a movable jaw upper lip axis 78.

A movable jaw transition angle θ2 can be measured from the movable jaw lower lip axis 74 to the movable jaw upper lip axis 78. The movable jaw transition angle θ2 can be in a range of zero degrees to ninety degrees, but is preferably about twenty degrees.

The movable jaw upper lip 76 is smoothly connected to a movable jaw upper channel wall 80. The movable jaw lower lip 72 is smoothly connected to a movable jaw channel lower wall 90. The movable jaw outer surface 64 is smoothly connected to a movable jaw distal end 82. The movable jaw distal end 82 further comprises a movable jaw channel 84.

The movable jaw channel 84 is bound by a movable jaw channel outer wall 86. The movable jaw channel outer wall 86 is directly connected to a movable jaw channel upper wall 88 and a movable jaw channel lower wall 90. Note that movable jaw channel outer wall 86 truncates from entering diameter Do to exit diameter De. The ratio of Do/De should be at least 1 but no more than 10. Preferably, the ratio of Do/De is about 3.33.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A pair of jaws for a twist tying machine; the pair of jaws comprising:

a fixed jaw, further comprising a housing configured to be attached to the twist tying machine and extending to a flat distal edge;

a fixed jaw channel, formed within the fixed jaw and configured to accommodate a product tie from the twist tying machine;

a movable jaw, rotatably attached to the twist tying machine and extending to a movable jaw distal end;

a movable jaw channel, formed within the movable jaw and configured to accommodate the product tie from the fixed jaw channel;

wherein, closing the movable jaw against the fixed jaw enables the product tie to travel through the movable jaw around a product, and through the fixed jaw creating a tie around the product a flat distal edge line, that is parallel to the flat distal edge;

an inclined portion, joined to the flat distal edge; wherein the inclined portion is parallel to an inclined portion line;

a fixed jaw transition angle is measured from the flat distal edge line to the inclined portion line;

wherein the fixed jaw transition angle is at least zero degrees but no more than ninety degrees a fixed jaw channel opening, that is hollowed out from the inclined portion; wherein the fixed jaw channel opening is the beginning of the fixed jaw channel further comprising a modified rectangular opening having a fixed jaw channel outer wall, a fixed jaw channel upper wall, and a fixed jaw channel lower wall;

a fixed jaw upper concave portion formed into the fixed jaw channel upper wall; and a fixed jaw lower concave portion formed into the fixed jaw channel lower wall.

2. The pair of jaws for a twist tying machine of claim 1, wherein the movable jaw further comprises:

a movable jaw lower surface;

a movable jaw outer surface, connected to the movable jaw lower surface;

a movable jaw upper surface, connected to the movable jaw outer surface;

a movable jaw lower attachment portion, connected to the movable jaw lower surface; wherein the movable jaw lower attachment portion is configured to be rotationally coupled to a linkage system on the twist tying machine; and a movable jaw upper attachment portion, connected to the movable jaw upper surface; wherein the movable jaw upper attachment portion is configured to be rotationally coupled to the linkage system on the twist tying machine.

3. The pair of jaws for a twist tying machine of claim 2, wherein the movable jaw further comprises:

a movable jaw lower lip joined to the movable jaw lower surface; wherein the movable jaw lower lip is centrally aligned on a movable jaw lower lip axis;

a movable jaw upper lip joined to the movable jaw upper surface; wherein the movable jaw upper lip is centrally aligned on a movable jaw upper lip axis;

a movable jaw transition angle, measured from the movable jaw lower lip axis to the movable jaw upper lip axis;

wherein the movable jaw transition angle is at least zero degrees but no more than ninety degrees.

4. The pair of jaws for a twist tying machine of claim 3, further comprising a movable jaw channel upper wall, connected to the movable jaw upper lip;

a movable jaw channel lower wall, connected to the movable jaw lower lip; and wherein the movable jaw distal end is connected to the movable jaw outer surface;

wherein the movable jaw distal end further comprises the movable jaw channel.

5. The pair of jaws for a twist tying machine of claim 3, wherein the movable jaw channel further comprises a movable jaw channel outer wall;

wherein the movable jaw channel upper wall is directly connected to the movable jaw channel outer wall;

wherein the movable jaw channel lower wall is directly connected to the movable jaw channel outer wall;

an entering diameter measured from the movable jaw channel upper wall to the movable jaw channel lower wall proximate the linkage system;

an exit diameter measured from the movable jaw channel upper wall to the movable jaw channel lower wall proximate the movable jaw distal end;

wherein a ratio of the entering diameter to the exit diameter is at least 3 but no more than 10.

6. A pair of jaws for a twist tying machine; the pair of jaws comprising:

a fixed jaw, further comprising a housing configured to be attached to the twist tying machine and extending to a flat distal edge;

a fixed jaw channel, formed within the fixed jaw and configured to accommodate a product tie from the twist tying machine;

a movable jaw, rotatably attached to the twist tying machine and extending to a movable jaw distal end;

a movable jaw channel, formed within the movable jaw and configured to accommodate the product tie from the fixed jaw channel;

wherein, closing the movable jaw against the fixed jaw enables the product tie to travel through the movable jaw around a product, and through the fixed jaw creating a tie around the product a flat distal edge line, that is parallel to the flat distal edge;

an inclined portion, joined to the flat distal edge; wherein the inclined portion is parallel to an inclined portion line;

a fixed jaw transition angle is measured from the flat distal edge line to the inclined portion line;

wherein the fixed jaw transition angle is at least zero degrees but no more than ninety degrees;

a fixed jaw channel opening, that is hollowed out from the inclined portion; wherein the fixed jaw channel opening is the beginning of the fixed jaw channel further comprising a modified rectangular opening having a fixed jaw channel outer wall, a fixed jaw channel upper wall, and a fixed jaw channel lower wall; a fixed jaw upper concave portion formed into the fixed jaw channel upper wall; and a fixed jaw lower concave portion formed into the fixed jaw channel lower wall; wherein the movable jaw further comprises:

a movable jaw lower lip joined to a movable jaw lower surface; wherein the movable jaw lower lip is centrally aligned on a movable jaw lower lip axis;

a movable jaw upper lip joined to a movable jaw upper surface; wherein the movable jaw upper lip is centrally aligned on a movable jaw upper lip axis;

a movable jaw transition angle, measured from the movable jaw lower lip axis to the movable jaw upper lip axis;

wherein the movable jaw transition angle is at least zero degrees but no more than ninety degrees.

7. The pair of jaws for a twist tying machine of claim 6, further comprising a movable jaw channel upper wall, connected to the movable jaw upper lip;

a movable jaw channel lower wall, connected to the movable jaw lower lip; and wherein the movable jaw distal end, connected to the movable jaw outer surface;

wherein the movable jaw distal end further comprises the movable jaw channel.

8. The pair of jaws for a twist tying machine of claim 7, wherein the movable jaw channel further comprises a movable jaw channel outer wall;

wherein the movable jaw channel upper wall is directly connected to the movable jaw channel outer wall;

wherein the movable jaw channel lower wall is directly connected to the movable jaw channel outer wall;

an entering diameter measured from the movable jaw channel upper wall to the movable jaw channel lower wall;

an exit diameter measured from the movable jaw channel upper wall to the movable jaw channel lower wall proximate the movable jaw distal end;

wherein a ratio of the entering diameter to the exit diameter is at least 3 but no more than 10.

* * * * *